US012173706B2

(12) United States Patent
Klein

(10) Patent No.: US 12,173,706 B2
(45) Date of Patent: Dec. 24, 2024

(54) HYDRAULIC MACHINE

(71) Applicant: White Drive Motors and Steering sp. z.o.o., Kobierzyce (PL)

(72) Inventor: Kamil Klein, Kobierzyce (PL)

(73) Assignee: WHITE DRIVE MOTORS AND STEERING sp. z.o.o., Kobierzyce (PL)

( * ) Notice: Subject to any disclaimer, the term of this patent is extended or adjusted under 35 U.S.C. 154(b) by 22 days.

(21) Appl. No.: 18/206,311

(22) Filed: Jun. 6, 2023

(65) Prior Publication Data

US 2023/0313818 A1 Oct. 5, 2023

Related U.S. Application Data

(63) Continuation of application No. PCT/EP2021/084713, filed on Dec. 8, 2021.

(51) Int. Cl.
*F04C 15/00* (2006.01)
*F04C 2/10* (2006.01)

(52) U.S. Cl.
CPC ..... *F04C 15/0046* (2013.01); *F04C 2/104* (2013.01)

(58) Field of Classification Search
CPC ..... F04C 15/0046; F04C 2/104; F04C 2/103; F04C 2/10
See application file for complete search history.

(56) References Cited

U.S. PATENT DOCUMENTS 3,606,598 A 9/1971 Albers
3,771,905 A * 11/1973 Ohrberg ..... F04C 2/105 137/625.21
4,082,480 A 4/1978 McDermott
4,106,883 A * 8/1978 Hansen ..... F04C 2/106 418/61.3
4,934,911 A * 6/1990 Schulz ..... F04C 2/106 418/61.3
2023/0313793 A1* 10/2023 Mrowczynski ..... F04C 2/103 418/191

FOREIGN PATENT DOCUMENTS

JP 2020059343 4/2020

OTHER PUBLICATIONS

International Search Report, PCT/EP2021/084713, International Filing Date Dec. 8, 2021.
Writtten Opinion of the International Searching Authority, PCT/EP2021/084713, International Filing Date Dec. 8, 2021.

* cited by examiner

*Primary Examiner* — Umashankar Venkatesan
(74) *Attorney, Agent, or Firm* — Ralph E. Jocke; WALKER & JOCKE

(57) ABSTRACT

A hydraulic machine (1) such as a pump or motor includes a working section (6) such as a gerotor. A spool (3) is rotatable about an axis (4) within a bore of the machine housing (2). The spool includes hydraulic fluid directing passages that enable operation of the machine. The spool includes first and second axially spaced apart circumferential grooves (14, 15). A plurality of first axial grooves (16) extend in intersecting relation with the first circumferential groove and a plurality of second axial grooves (17) extend in intersecting relation with the second circumferential groove. The first and second axial grooves are arranged in alternating relation about the circumference of the spool. The circumferential grooves are bounded radially inwardly by respective bottom walls (19, 22) that have a greater radial distance from the axis with axial proximity to the intersecting grooves.

20 Claims, 2 Drawing Sheets

HYDRAULIC MACHINE

TECHNICAL FIELD

Exemplary arrangements relate to hydraulic machines such as hydraulic motors and hydraulic pumps. Exemplary arrangements further relate to structures within such hydraulic machines that are operative to selectively route the flow of hydraulic fluid during machine operation.

BACKGROUND

Hydraulic machines often operate by selectively routing the flow of hydraulic fluid within the machine. In many situations the flow of hydraulic fluid within the machine is at high pressures. Arrangements for routing the flow of hydraulic fluid may be subject to leakage, deformation and/or wear due to the high pressures that are encountered.

Some environments in which such conditions may rise include hydraulic machines that include gerotor arrangements. Some such hydraulic machines which include gerotor arrangements may operate as positive displacement pumps. Other hydraulic machines which include gerotor arrangements may operate as hydraulic motors. Other types of hydraulic machines may include other types of hydraulic components for which the routing of flow must be accurately and efficiently controlled.

Prior arrangements for such hydraulic machines may benefit from improvements.

SUMMARY

Exemplary arrangements relate to a hydraulic machine that includes a housing. The exemplary housing includes a working section that includes a gerotor. The exemplary housing further includes a flow control section with an arrangement for directing the flow of hydraulic fluid to and from the areas bounded by the gear teeth of the gerotor.

An exemplary hydraulic fluid flow directing arrangement includes a cylindrical bore which extends along an axis within the machine. The bore is bounded by a cylindrical bore wall that includes angularly spaced fluid openings each of which is configured to deliver or receive hydraulic fluid.

A cylindrical spool extends in the bore and is rotatable within the bore about an axis. The spool includes a generally cylindrical outer surface. The exemplary outer surface includes a pair of axially disposed radially inwardly extending first and second circumferential grooves. Each of the circumferential grooves is bounded radially inwardly by a respective bottom wall surface.

A plurality of angularly disposed first axial grooves extend radially inward in the spool. Each of the first axial grooves extends axially intermediate of the first and second circumferential grooves. Each of the first axial grooves extends in intersecting relation with the first circumferential groove. The intersecting relation between the first axial grooves in the first circumferential groove enables hydraulic fluid to flow between the first axial grooves and the circumferential groove.

A plurality of angularly disposed second axial grooves extend radially inward in the spool. Each of the second axial grooves extend axially intermediate of the first and second circumferential grooves. Each of the second axial grooves also extends in intersecting relation with the second circumferential groove enabling hydraulic fluid flow therebetween. Each second axial groove is positioned angularly intermediate of the pair of immediately adjacent first axial grooves.

In the exemplary arrangement the bottom surface which radially inwardly bounds the first circumferential groove is configured so that in transverse diametric cross section the bottom surface is positioned further radially outward from the axis of the spool with increased axial proximity to the first axial grooves. Further the bottom surface which radially inwardly bounds the second circumferential groove is configured so that in transverse diametric cross section the bottom surface is positioned further radially outward from the axis of the spool with increased axial proximity to the second axial grooves.

The exemplary arrangement may be used in a machine configuration in which the spool has an axially extending recess that includes an internally splined portion configured for engaging a splined shaft. In some exemplary arrangements this shaft may include a dog bone or cardan shaft that is in operative connection with an orbital rotational star wheel of a gerotor. In such configurations where at least one of the first and second circumferential grooves at least partially radially outwardly overlies the splined portion, the exemplary configuration of the bottom surfaces bounding the circumferential grooves provides added resistance to deformation which minimizes leakage and facilitates efficient pump operation.

Of course it should be understood that these hydraulic machine configurations are exemplary of numerous different configurations which apply the principles described herein.

DETAILED DESCRIPTION

Figure 1:
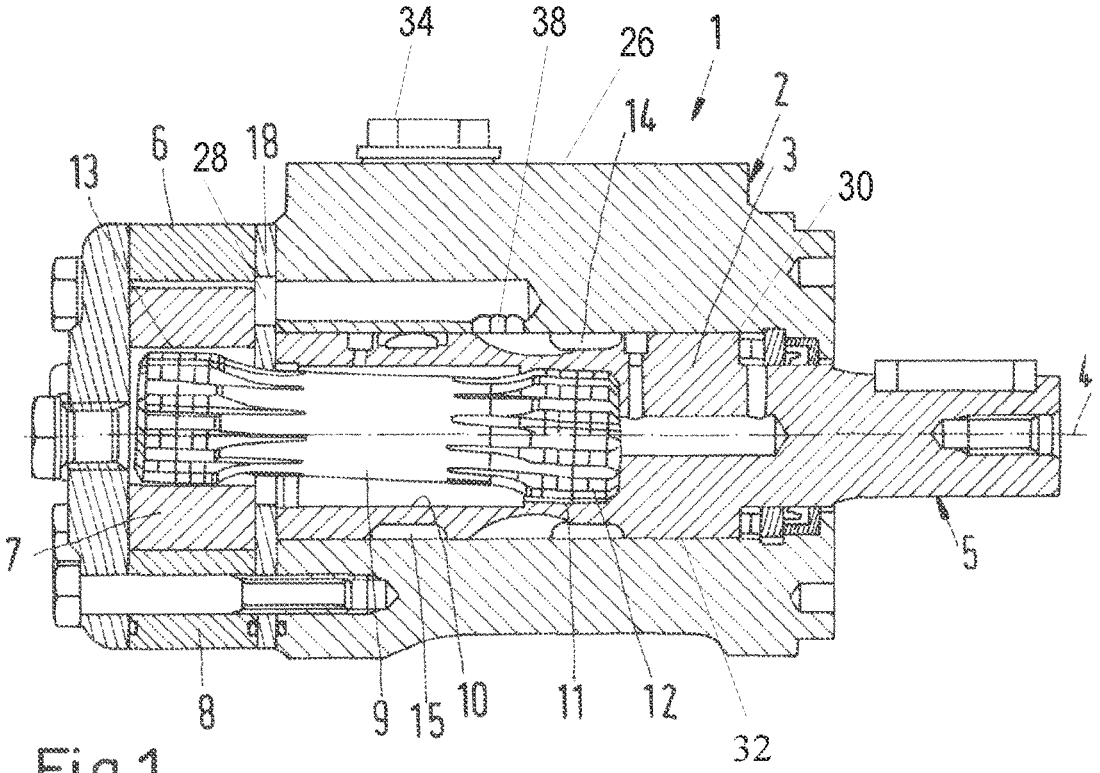
FIG. 1 is a cross sectional view of an exemplary hydraulic machine including the features of an exemplary arrangement.

Exemplary arrangements relate to a machine that receives hydraulic fluid through an inlet port, supplies the fluid to a working section of the machine such as a gerotor, receives fluid from the working section and delivers it from the machine such as through an outlet port. In some exemplary arrangements the working section may operate as a hydraulic pump. In other exemplary arrangements the working section may operate as a hydraulic motor. In other exemplary arrangements the working section may operate as a different type of hydraulic device.

An exemplary hydraulic machine in which a fluid directing arrangement is used to receive and direct hydraulic fluid under high pressure to a working section, and return hydraulic fluid with low pressure such as to a return tank, is shown in U.S. Pat. No. 4,082,480 the disclosure of which is incorporated herein by reference in its entirety. A further exemplary hydraulic machine which includes a fluid directing arrangement is shown in U.S. Pat. No. 3,606,598 the disclosure of which is also incorporated herein by reference in its entirety. These incorporated disclosures detail fluid directing arrangements which include certain features similar to those described herein which in exemplary arrangements direct internal hydraulic fluid flow as needed for operation of the machine.

In the exemplary arrangements described herein a hydraulic machine generally indicated 1 includes a housing 2. The exemplary machine includes a pair of hydraulic fluid ports generally indicated 34, only one of which is shown. The exemplary machine includes a hydraulic fluid inlet port and a hydraulic fluid outlet port. The exemplary housing includes a fluid control section 26 with an internal generally cylindrical bore 30. When used herein the term generally cylindrical means that a majority of the structure has a cylindrical shape. The bore 30 is bounded by a generally cylindrical bore wall 32.

A generally cylindrical spool 3 is positioned in the bore 30. The exemplary spool is rotatable in the bore 30 about an axis of rotation 4. The spool is axially stationary within the bore 30. The exemplary spool 2 is in operatively fixed rotatable connection with a spool shaft 5. The exemplary spool includes a generally cylindrical outer spool surface 36. In the exemplary arrangement the outer spool surface 36 is in close immediately adjacent facing relation with the cylindrical bore wall 32. In the exemplary arrangement close tolerances are maintained between the outer spool surface and the cylindrical bore wall to minimize fluid leakage between the fluid passages within the machine. Of course it should be understood that this approach is exemplary and in other arrangements other sealing methods may be used.

The exemplary machine includes a working section 6. In the exemplary arrangement the working section includes a gerotor. The exemplary gerotor includes a star wheel 7. The star wheel 7 extends within a ring gear 8. The star wheel 7 is arranged eccentrically within the ring gear 8. In the exemplary arrangement the star wheel includes a plurality of outward extending teeth. The ring gear includes a plurality of inward extending teeth which in the exemplary arrangement is one more tooth than the number of outward extending teeth on the star wheel.

In the exemplary arrangement the star wheel 7 rotates within the interior area of the ring gear. The central axis of the star wheel also moves in an orbital manner. As the teeth of the star wheel and the ring gear sequentially engage, areas of increasing and decreasing volume between the teeth are produced in a manner like that described in the incorporated disclosures. In the exemplary arrangement in which the inlet port of the housing is supplied with hydraulic fluid at an elevated pressure, the star wheel is caused to move in a rotating and orbital manner in engagement with the ring gear as high pressure fluid is directed to cause expansion of the volume of certain areas that are bounded by the engaged teeth and fluid is directed out of other areas that are bounded by the engaged teeth to enable the reduction in the volume thereof.

The rotating and orbitally moving star wheel 7 is operatively connected to the spool 3 and causes the spool to rotate about the axis 4. The exemplary spool 3 includes an axially extending generally cylindrical spool axial recess 10 which is alternatively referred to herein as a hollow. The spool axial recess includes a splined portion 11 which is alternatively referred to herein as a splined region. A dog bone shaft which is alternatively referred to herein as a cardan shaft 9, operatively connects the star wheel 7 and the spool 3. The exemplary dog bone 9 comprises a splined end 12 which is in rotationally engaged connection with the splined portion 11 of the spool axial recess 10. The exemplary dog bone 9 further includes a further splined end 13 at an axially opposed end from the splined end 12. The splined end 13 is in rotationally engaged connection with a splined recess within the star wheel 7. Of course it should be understood that this arrangement is exemplary and in other arrangements other structures and configurations may be used.

The exemplary spool 3 comprises a radially inward extending first circumferential groove 14. The first circumferential groove 14 extends radially inward from the outer generally cylindrical spool surface 36. The spool 3 further includes a radially inward extending second circumferential groove 15 which similarly extends radially inward from the outer spool surface 36. The first circumferential groove 14 is axially disposed from the second circumferential groove 15.

A plurality of angularly spaced first axial grooves 16 extend radially inward in the spool from the outer cylindrical surface 36. In the exemplary arrangement the first axial grooves are uniformly angularly spaced circumferentially on the spool. Each of the first axial grooves is disposed angularly away from each of the other first axial grooves. Each of the first axial grooves 16 extends in intersecting relation with the first circumferential groove 14. In the exemplary arrangement at least 35% of the total axial length of each of the first axial grooves is in intersecting relation with the first circumferential groove 14. This configuration is used in the exemplary arrangement to facilitate hydraulic fluid flow between the first axial grooves and the first circumferential groove. However it should be understood that this configuration is exemplary and in other arrangements other approaches may be used.

A plurality of angularly spaced second axial grooves 17 extend radially inward in the spool 3 from the spool outer surface 36. In the exemplary arrangement the second axial grooves are uniformly spaced circumferentially such that each second axial groove is angularly spaced away from each other second axial grooves. Each second axial groove 17 extends in intersecting relation with the second circumferential groove 50. Further in the exemplary arrangement at least 35% of the total axial length of each second axial groove is in intersecting relation with the second circumferential groove 15. As can be appreciated the first axial grooves 16 do not engage in intersecting relation with the second circumferential groove 15, and the second axial grooves 17 do not engage in intersecting relation with the first circumferential groove 14.

Further in the exemplary arrangement each respective second axial groove 17 is angularly positioned in intermediate relation of each angularly immediately adjacent pair of first axial grooves 16. Likewise each respective first axial groove 16 is angularly positioned in intermediate relation of each angularly immediately adjacent pair of second axial grooves 17. As a result the first axial grooves 16 and the second axial grooves 17 are arranged alternatively about the circumference of the spool 3.

In the exemplary arrangement a distributor plate 18 extends between the working section 6 and the cylindrical bore 30. The distributor plate which may be of the type described in the incorporated disclosures, includes distributor plate openings 28 which provide fluid passages for hydraulic fluid that passes between the working section and fluid openings 38 and other fluid passages that extend in the housing 2. As can be appreciated in the exemplary arrangement the bore wall 32 includes a plurality of angularly disposed fluid openings which are configured to pass hydraulic fluid therethrough. In the exemplary arrangement the plurality of fluid openings are generally circularly aligned, which for purposes hereof means that they extend substantially within an annular area of the bore wall 32. Further the fluid openings are positioned axially intermediate of the first circumferential groove 14 and the second circumferential groove 15. This enables the axial grooves 15, 16 to be in axially overlapping relation with each of the fluid openings. As a result each axial groove is in fluid communication with the respective fluid opening with which the axial groove becomes radially aligned during rotation of the spool 3. As a result the exemplary arrangement enables directing hydraulic fluid along fluid paths within the housing as necessary to achieve the operation of the hydraulic machine.

Figure 3:
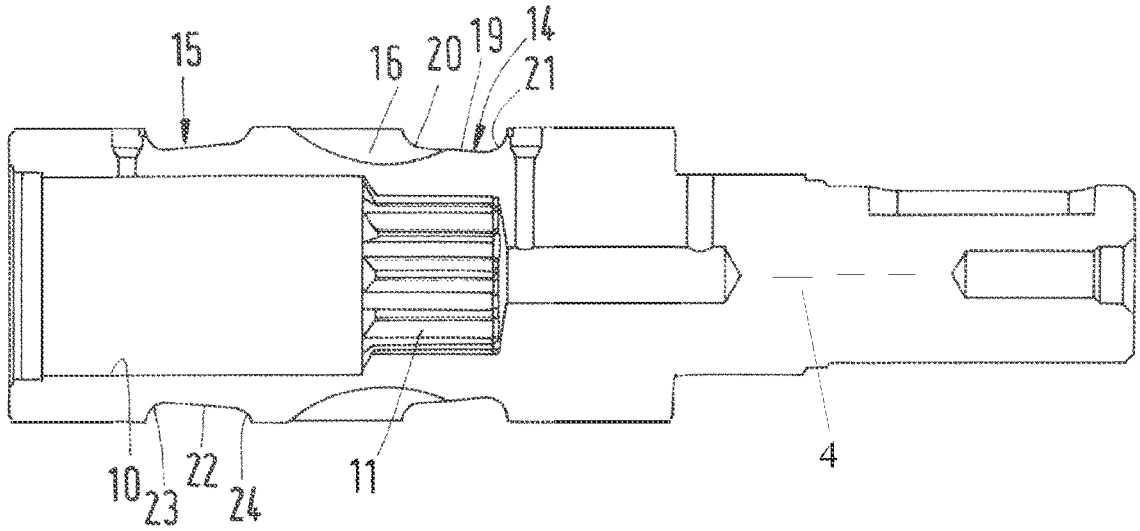
FIG. 3 is a transverse diametric cross sectional view of the exemplary spool.

As shown in transverse diametric cross section in FIG. 3, the exemplary spool 3 is configured such that each of the first circumferential groove 14 and the second circumferential groove 15 extend in radially outward overlying relation of the spool axial recess 10. The first circumferential groove 14 further extends at least partially in radially outwardly overlying relation of the splined portion 11.

In the exemplary arrangement the first circumferential groove 14 is radially inwardly bounded by a first bottom wall 19. The first bottom wall 19 extends axially between two transition areas 20, 21. The transition areas define the radially inward transition between the first bottom wall 19 and the side walls of the first circumferential groove 14. In the exemplary arrangement the first bottom wall does not run parallel to the axis 4. Rather the radial distance of the first bottom wall from the axis varies with the axial position of the first bottom wall within the first circumferential groove.

In the exemplary arrangement the first bottom wall 19 which radially inwardly bounds the first circumferential groove 14 in transverse diametric cross section, is inclined with respect to the axis 4 such that the distance between the first bottom wall 19 and the axis 4 is greater with axial proximity to the first axial grooves 16. In the exemplary arrangement the first bottom wall 19 comprises a generally straight wall portion that extends at an angle within a range of between 1° and 15° relative to the axis 4. In some exemplary arrangements the first bottom wall extends at an angle relative to the axis within a range of between 5° to 8°. In some other exemplary arrangements the first bottom wall extends at an angle relative to the axis of about 6°. Of course these configurations are exemplary and in other arrangements other configurations and approaches may be used.

This exemplary configuration of the bottom wall of the first circumferential groove 14 provides for a greater radial thickness of spool material between the bottom wall of the circumferential groove and the radially underlying spool axial recess. In this exemplary arrangement the greater radial thickness of material provides greater strength and resistance to spool deformation. Further the increased resistance to deformation maintains the close tolerances between the outer spool surface 36 and bore wall 32 of the cylinder during operation which minimizes fluid leakage from the fluid paths that extend between the radially aligned axial grooves 16 and fluid openings 20. This results in more efficient operation of the working section 6.

Figure 2:
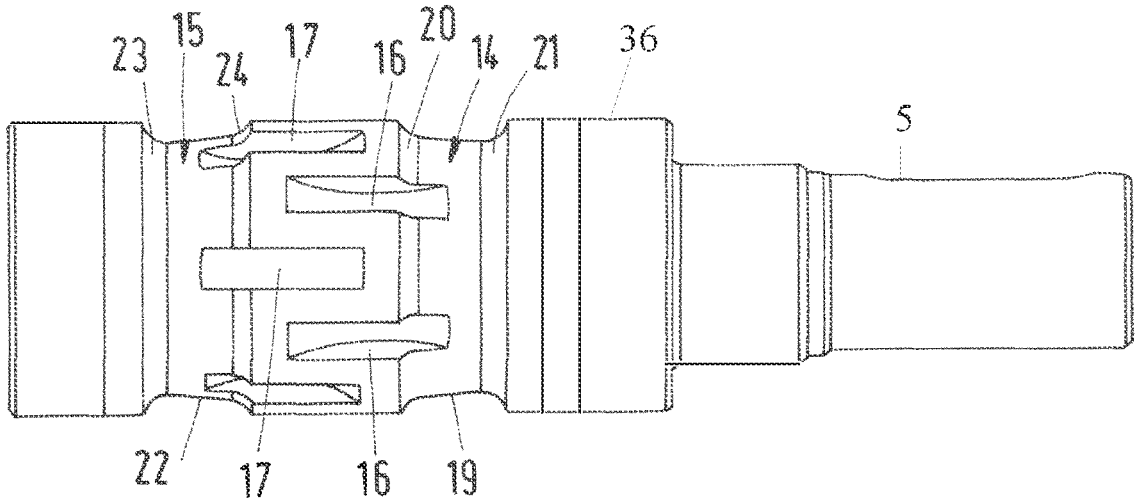
FIG. 2 is a side view of an exemplary spool used in the exemplary hydraulic machine arrangement.

In the exemplary arrangement as shown in greater detail in FIG. 2, each first axial groove 16 extends in intersecting relation with the first circumferential groove along at least 35% of the total axial length of the axial groove 16. In the exemplary arrangement this configuration is operative to avoid any significant increase in throttling resistance to hydraulic fluid flow at the entrance or input openings to the first axial grooves 16. This minimization of resistance to fluid flow is achieved even though the first bottom wall 19 does not extend parallel to the axis of rotation 4 of the spool 3. Of course it should be understood that this approach is exemplary and in other arrangements other configurations may be utilized to minimize resistance to fluid flow between the axial grooves and the circumferential groove to which they are fluidly connected.

Figure 4:
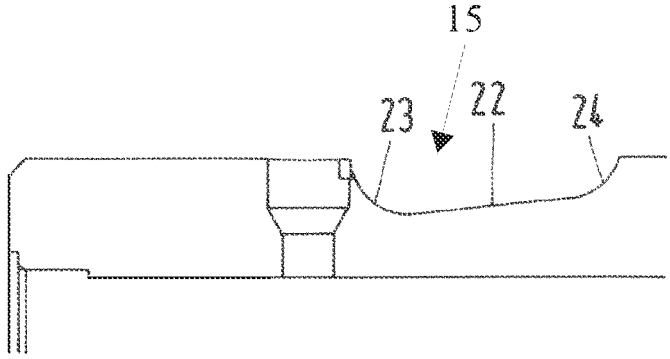
FIG. 4 is an enlarged portion of the spool shown in FIG. 3.

In the exemplary arrangement the second circumferential groove 15 is radially inwardly bounded in transverse diametric cross section by a second bottom wall 22. This is shown for example in FIG. 4. In cross section the second circumferential groove is bounded by second bottom wall 22 which extends between two transition regions, 23, 24. The transition regions 23, 24 provide a transition between the second bottom wall 22 and the side walls of the second circumferential groove along the circumferential direction.

In the exemplary arrangement the radial distance of the second bottom wall 22 from the axis 4 varies with the axial position of the second bottom wall within the second circumferential groove 15. In the exemplary arrangement the radial distance between the second bottom wall 22 and the axis 4 increases with axial proximity to the second axial grooves 17. The exemplary second bottom wall includes a generally straight wall portion that is inclined with respect to the axis of rotation 4 by an angle that is within a range of between 1° and 15°. In some exemplary arrangements the angle is within a range of between 5° to 8°. In some other exemplary arrangements the angle is about 6°. Of course it should be understood that this configuration is exemplary and in other arrangements other configurations may be used.

In some exemplary arrangements it is desirable to have the configurations of the first and second circumferential grooves 14, 15 be a mirror image of one another in transverse diametric cross section. Likewise in some exemplary arrangements the axially extending grooves 16, 17 have a mirror image configuration. This provides for more uniform hydraulic fluid flow during rotation of the spool and operation of the hydraulic machine. Of course these approaches are exemplary and in other arrangements other approaches may be used.

Further in the exemplary configuration of the spool 3, each of the second axial grooves 17 extends in intersecting relation with the second circumferential groove 15. Similar to the relationship between the first axial grooves and the first circumferential groove, at least 35% of the total axial length of each second axial groove 17 extends in intersecting relation with the second circumferential groove 15. This provides for desirable hydraulic fluid flow properties between the second axially extending grooves and the second circumferential groove.

Of course it should be understood that in some exemplary arrangements it may be necessary to only have one of the circumferential grooves bounded radially inward by a respective bottom wall that varies in its radial distance from the axis with the axial position of the bottom wall within the circumferential groove. This approach may be used for example, in arrangements where the hydraulic machine is configured to only operate in one rotational direction. Further other machine configurations or other desired operational properties may benefit from the utilization of different or additional structures and configurations compared to the exemplary arrangements that have been described herein.

Thus the exemplary arrangements achieve improved operation, eliminate difficulties encountered in the use of prior devices, and attain the useful results that are described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features and relationships are not limited to the exact features and relationships that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes, and relationships are set forth in the appended claims.

I claim:

1. Apparatus comprising:

a hydraulic machine including a housing, wherein the housing includes a cylindrical bore, wherein the cylindrical bore extends along an axis, is bounded by a cylindrical bore wall, wherein the cylindrical bore wall includes a plurality of generally circularly aligned angularly disposed fluid openings, wherein each fluid opening is configured to pass hydraulic fluid therethrough, a spool, wherein the spool extends within the bore, and is rotatable within the bore about the axis, includes an outer cylindrical spool surface, wherein the outer cylindrical spool surface is in immediately facing relation with the cylindrical bore wall and includes a radially inward extending first circumferential groove, a radially inward extending second circumferential groove, wherein the second circumferential groove is axially disposed from the first circumferential groove, and the plurality of fluid openings are axially disposed away from and positioned axially intermediate of the first and second circumferential grooves, a plurality of radially inward extending first axial grooves, wherein each of the first axial grooves is angularly disposed from each of the other first axial grooves, extends in intersecting relation with the first circumferential groove, a plurality of radially inward extending second axial grooves, wherein each of the second axial grooves it is angularly disposed from each of the other second axial grooves, extends in intersecting relation with the second circumferential groove, and extends in angularly intermediate relation of an immediately angularly adjacent pair of first axial grooves, wherein each of the first and second axial grooves is in axially overlapping relation with each of the plurality of fluid openings, whereby each respective first and second axial groove is configured to be in fluid communication with the respective fluid opening with which a respective axial groove is radially aligned, wherein the first circumferential groove is bounded radially inward by a first bottom wall, wherein radial distance of the first bottom wall from the axis varies with axial position of the first bottom wall within the first circumferential groove.

2. The apparatus according to claim 1 wherein the radial distance of the first bottom wall from the axis is greater with axial proximity to the first axial grooves.

3. The apparatus according to claim 1 wherein the axial distance of the first bottom wall from the axis is greater with axial proximity to the first axial grooves, wherein the first bottom wall extends in diametric transverse cross section at a first angle relative to the axis.

4. The apparatus according to claim 1 wherein the axial distance of the first bottom wall from the axis is greater with axial proximity to the first axial grooves, wherein the first bottom wall extends in diametric transverse cross section at a first angle relative to the axis, wherein the first angle is in a range of from 1° to 15°.

5. The apparatus according to claim 1 wherein the axial distance of the first bottom wall from the axis is greater with axial proximity to the first axial grooves, wherein the first bottom wall extends in diametric transverse cross section at a first angle relative to the axis, wherein the first angle is in a range of from 5 to 8°.

6. The apparatus according to claim 1 wherein at least 35% of a total axial length of each first axial groove is in intersecting relation with the first circumferential groove.

7. The apparatus according to claim 1 wherein the second circumferential groove is bounded radially inward by a second bottom wall, wherein radial distance of the second bottom wall from the axis of rotation varies with axial position of the second bottom wall within the second circumferential groove.

8. The apparatus according to claim 1 wherein the axial distance of the second bottom wall from the axis is greater with axial proximity to the second axial grooves.

9. The apparatus according to claim 1 wherein the axial distance of the second bottom wall from the axis is greater with axial proximity to the second axial grooves, wherein the second bottom wall extends in diametric transverse cross section at a second angle relative to the axis.

10. The apparatus according to claim 1 wherein the axial distance of the second bottom wall from the axis is greater with axial proximity to the second axial grooves, wherein the second bottom wall extends in diametric transverse cross section at a second angle relative to the axis, wherein the second angle is in a range of from 1° to 15°.

11. The apparatus according to claim 1 wherein the axial distance of the second bottom wall from the axis is greater with axial proximity to the second axial grooves, wherein the second bottom wall extends in diametric transverse cross section at a second angle relative to the axis, wherein the second angle is in a range of from 5° to 8°.

12. The apparatus according to claim 1 wherein at least 35% of a total axial length of each second axial groove is in intersecting relation with the second circumferential groove.

13. The apparatus according to claim 1
wherein the radial distance of the first bottom wall from the axis is greater with axial proximity to the first axial grooves, and
wherein the radial distance of the second bottom wall from the axis is greater with axial proximity to the second axial grooves.

14. The apparatus according to claim 1
wherein the radial distance of the first bottom wall from the axis is greater with axial proximity to the first axial grooves, and
wherein the radial distance of the second bottom wall from the axis is greater with axial proximity to the second axial grooves,
wherein each of the first bottom wall and the second bottom wall extend in diametric transverse cross section at an angle of from 1° to 15° relative to the axis.

15. The apparatus according to claim 1
wherein the radial distance of the first bottom wall from the axis is greater with axial proximity to the first axial grooves,
wherein the radial distance of the second bottom wall from the axis is greater with axial proximity to the second axial grooves,
wherein at least 35% of a total axial length of each first axial groove is in intersecting relation with the first circumferential groove, and
wherein at least 35% of a total axial length of each second axial groove is in intersecting relation with the second circumferential groove.

16. The apparatus according to claim 1
wherein the hydraulic machine includes a gerotor.

17. The apparatus according to claim 1
wherein the spool further includes
an axially extending spool axial recess,
wherein the spool axial recess includes an annular splined portion,
wherein the annular splined portion is configured to engage a shaft that extends in the spool axial recess,
wherein at least one of the first circumferential groove and the second circumferential groove at least partially radially outwardly overlies the splined portion.

18. Apparatus comprising:
a hydraulic machine that includes
a hydraulic fluid flow directing arrangement including a generally cylindrical spool,
wherein the spool is rotatable in axially fixed rotatable relation within a cylindrical bore of the machine,
wherein the spool includes
a pair of axially disposed first and second radially inward extending circumferential grooves,
wherein each circumferential groove is bounded radially inward by a respective bottom wall,
a plurality of angularly spaced radially inward extending first axial grooves,
wherein each first axial groove extends
axially intermediate of the first and second circumferential grooves, and
in intersecting relation with the first circumferential groove and not the second circumferential groove,
a plurality of angularly spaced radially inward extending second axial grooves,
wherein each second axial groove extends
axially intermediate of the first and second circumferential grooves, and
in intersecting relation with the second circumferential groove and not the first circumferential groove,
wherein each first axial groove extends angularly intermediate of an immediately angularly adjacent pair of second axial grooves,
wherein the respective bottom wall of the first circumferential groove in transverse diametric cross section extends further radially outward from the axis with axial proximity to the first axial grooves.

19. The apparatus according to claim 18
wherein the respective bottom wall of the second circumferential groove in transverse diametric cross section extends further radially outward from the axis with axial proximity to the second axial grooves.

20. Apparatus comprising:
a hydraulic machine including a hydraulic fluid flow directing spool,
wherein the spool is in fixed axial and rotatable relation within a bore of the machine,
wherein the spool extends along an axis and includes
an axially extending recess,
wherein the axially extending recess includes an annular internal splined portion, wherein splined portion is configured to operatively engage a rotatable shaft,
a generally cylindrical outer surface, wherein the outer surface includes
a radially inward extending first circumferential groove,
a radially inward extending second circumferential groove,
wherein the first circumferential groove is axially disposed from the second circumferential groove,
wherein at least one of the first circumferential groove and the second circumferential groove extends in at least partially radially outwardly overlying relation of the splined portion,
a plurality radially inward extending angularly spaced first axial grooves,
wherein each of the first axial grooves
intersects with the first circumferential groove and not the second circumferential groove,
a plurality of radially inward extending angularly spaced second axial grooves,
wherein each of the second axial grooves
is positioned angularly intermediate of an angularly immediately adjacent pair of first axial grooves, and
intersects with the second circumferential groove and not the first circumferential groove,
wherein the first circumferential groove in transverse diametric cross section is bounded radially inward by a first bottom wall,
wherein the second circumferential grove in transverse diametric cross section is bounded radically inward by a second bottom wall,
wherein the respective first bottom wall or second bottom wall of at least one of the first circumferential groove or the second circumferential groove that extends in at least partially radially outward overlying relation of the splined portion, extends further radially outward from the axis with axial proximity to the respective intersecting first axial grooves or second axial grooves.

* * * * *